US010054394B2

(12) United States Patent
Jen et al.

(10) Patent No.: US 10,054,394 B2
(45) Date of Patent: Aug. 21, 2018

(54) RETRACTABLE BUTTSTOCK FOR FIREARMS

(71) Applicants: Yi Huei Jen, Irvine, CA (US); Garrett O'Neill Keller, Santa Ana, CA (US); David Hyung Chin, Huntington Beach, CA (US)

(72) Inventors: Yi Huei Jen, Irvine, CA (US); Garrett O'Neill Keller, Santa Ana, CA (US); David Hyung Chin, Huntington Beach, CA (US)

( * ) Notice: Subject to any disclaimer, the term of this patent is extended or adjusted under 35 U.S.C. 154(b) by 25 days.

(21) Appl. No.: 15/408,048

(22) Filed: Jan. 17, 2017

(65) Prior Publication Data

US 2017/0205190 A1 Jul. 20, 2017

Related U.S. Application Data

(60) Provisional application No. 62/279,270, filed on Jan. 15, 2016.

(51) Int. Cl.

| | |
|---|---|
| ***F41A 25/00*** | (2006.01) |
| ***F41C 23/14*** | (2006.01) |
| ***F41A 3/84*** | (2006.01) |

(52) U.S. Cl.

CPC ..... *F41C 23/14* (2013.01); *F41A 3/84* (2013.01)

(58) Field of Classification Search

CPC ..... F41C 23/04; F41C 23/14; F41C 23/20

See application file for complete search history.

(56) References Cited

U.S. PATENT DOCUMENTS

| | | | | |
|---|---|---|---|---|
| 6,564,492 | B2 * | 5/2003 | Weldle | F41C 23/14 42/73 |
| 8,061,072 | B1 * | 11/2011 | Crose | F41C 23/04 42/71.01 |
| 8,434,252 | B2 * | 5/2013 | Holmberg | F41A 3/84 42/1.06 |
| 9,297,609 | B2 * | 3/2016 | Burt | F41C 23/16 |
| 9,347,739 | B2 * | 5/2016 | Gomirato | F41C 23/04 |
| 9,574,846 | B2 * | 2/2017 | Huang | F41A 3/66 |
| 9,625,232 | B2 * | 4/2017 | Gomez | F41C 23/06 |
| 2014/0190056 | A1 * | 7/2014 | Troy | F41C 23/14 42/71.01 |
| 2016/0116249 | A1 * | 4/2016 | Maugham | F41C 23/08 42/74 |
| 2016/0305728 | A1 * | 10/2016 | Stewart | F41A 17/063 |
| 2017/0023328 | A1 * | 1/2017 | Irvin | F41C 23/04 |

FOREIGN PATENT DOCUMENTS

| | | | | |
|---|---|---|---|---|
| DE | 1225517 B | * | 9/1966 | F41C 23/04 |

* cited by examiner

*Primary Examiner* — Gabriel J Klein

(57) ABSTRACT

In one aspect, a retractable buttstock may include a buttpad that allows the user to rest the weapon on their shoulders; a pair of extension rods; a buffer tube that allows the buttstock to attach to the firearm; and a buffer tube housing to receive the buffer tube. In an exemplary embodiment, the extension rods are hollow and a resilient unit is received in each extension rod. The extension rods have a pair of first positioning grooves and a pair of second positioning grooves to engage with stoppers of the buffer tube housing. The buttstock can be fully-extended and collapsed depending on whether the stoppers engage with the first or second positioning grooves. It is noted that the user can operate the retractable buttstock with one hand.

8 Claims, 5 Drawing Sheets

RETRACTABLE BUTTSTOCK FOR FIREARMS

CROSS-REFERENCE TO RELATED APPLICATIONS

This application claims priority under 35 U.S.C. § 119 (e) to U.S. Provisional Patent Application Ser. No. 62/279,270, filed on Jan. 15, 2016, the entire contents of which are hereby incorporated by reference.

FIELD OF THE INVENTION

The present invention relates buttstocks for firearms, and more particularly to a retractable buttstock with spring-loaded extension rods so that the user can easily operate the buttstock.

BACKGROUND OF THE INVENTION

It is popular to adapt or modify firearms, as evidenced by the large availability of aftermarket accessories available to firearm users. Accessories add to a firearm's functionality or appearance. A recognized accessory to add to a firearm is a retractable, telescoping, or collapsible buttstock.

Conventional retractable buttstocks operate via the user manually sliding the buttpad on an extension or guide rods. Manual movement is needed from the user to slide the buttpad up and down the extension or rods, namely taking the firearm from a compact configuration to an outright configuration. Conventional retractable buttstocks are disadvantageous because the user needs to use both hands to operate the buttstock.

For example, U.S. Pat. No. 7,162,822 to Heayn et al. discloses a collapsible buttstock for firearms having a buffer recoil mechanism is collapsible and adjustable. The buttstock includes a lower receiver extension having a bore therein that fits over the buffer recoil mechanism, the lower receiver extension being fixed to the buffer recoil mechanism; a buttstock body having a bore therein for receiving the lower receiver extension; a locking lever disposed along the bottom edge of the buttstock body; a locking pin disposed in the buttstock body and in the locking lever; and a compression spring disposed around the locking pin for biasing the locking pin towards the lower receiver extension. However, the user may still have to use both hands to operate the collapsible buttstock disclosed in Heayn.

Moreover, the personal defense weapon (PDW) was created in response to users who need a compact and portable weapon that can be carried with ease since the user may need to operate the PDW inside a vehicle or other tight spaces. Users of PDWs, such as law enforcement, private security groups, and military personnel, find themselves in situations where they must be able to quickly transition from inside a vehicle or carrier and straight into a combat or live-fire situation. Accordingly, the user's PDWs need to be quickly adapted and easily operated.

Therefore, there remains a need for a new and improved design for a buttstock that can be quickly changed from a collapsed configuration to an extended configuration with less manual effort and input from the user.

SUMMARY OF THE INVENTION

It is an object of the present invention to provide a retractable buttstock that can be quickly collapsed into a compact position so the buttstock is easy for transportation.

It is another object of the present invention to provide a retractable buttstock with spring-loaded extension rods to allow the buttstock to quickly collapse and extend.

It is a further object of the present invention to provide a retractable buttstock with spring-loaded extension rods which enables the user to operate the mechanism with one hand, while maintaining weapon control with the firing hand.

In one aspect, a retractable buttstock may include a buttpad that allows the user to rest the weapon on their shoulders, so the weapon is stabilized and is easier for the user to shoot; a pair of extension rods; a buffer tube that is part of the firearm that allows the buttstock to attach to the firearm; and a buffer tube housing to receive the buffer tube. In one embodiment, the buttpad has a first pair of receiving holes, and each receiving hole is configured to receive one end of each extension rod. The buffer tube housing has a second pair of receiving holes, and each receiving hole is configured to movably receive the other end of each extension rod. In other words, the buffer tube housing can slide along the extension rods from one end to the other end thereof.

In an exemplary embodiment, the extension rods are hollow and a resilient unit is received in each extension rod. The extension rods may have one or more pairs of positioning grooves including a pair of first positioning grooves closer to the first receiving holes and a pair of second positioning grooves closer to the second receiving holes. It is noted that each of the first and second positioning groove is located at a substantially similar position on each extension rod. The extension rod may also have a pair of third positioning grooves located between the first and second positioning grooves to secure the buffer tube housing. The buffer tube housing has a release button underneath the second receiving holes, and the release button has a pair of stoppers to engage with either the first positioning grooves or second positioning grooves.

When the user wants to collapse the buttstock, the user can simply press the release button to disengage the stoppers with the second positioning grooves, and move the buffer tube housing towards the buttpad. It is noted that since the resilient units are in their fully extended positions at the time when the buttstock is being collapsed, an external force from the user has to be applied to the resilient units to compress the resilient units until the stoppers of the release button engage with the first positioning grooves.

To return to the fully-extended configuration from the collapsed configuration, the user can simply press the release button. More specifically, when the release button is pressed, the stoppers disengage with the first positioning grooves and the buffer tube housing can automatically move away from the buttpad until the stoppers engage with second positioning grooves. It is noted that since the resilient units are at their compressed positions at the time when the buttstock is being extended, the resilient force of the resilient units will push the buffer tube housing without applying any external force. Relatively speaking, if the buffer tube housing is fixed to a firearm, the buttpad would automatically move away from the buffer tube housing through the spring actuated movement of the extension rods when the configuration of the buttstock is changing from collapsed to fully-extended.

DETAILED DESCRIPTION OF THE INVENTION

Figure 1:
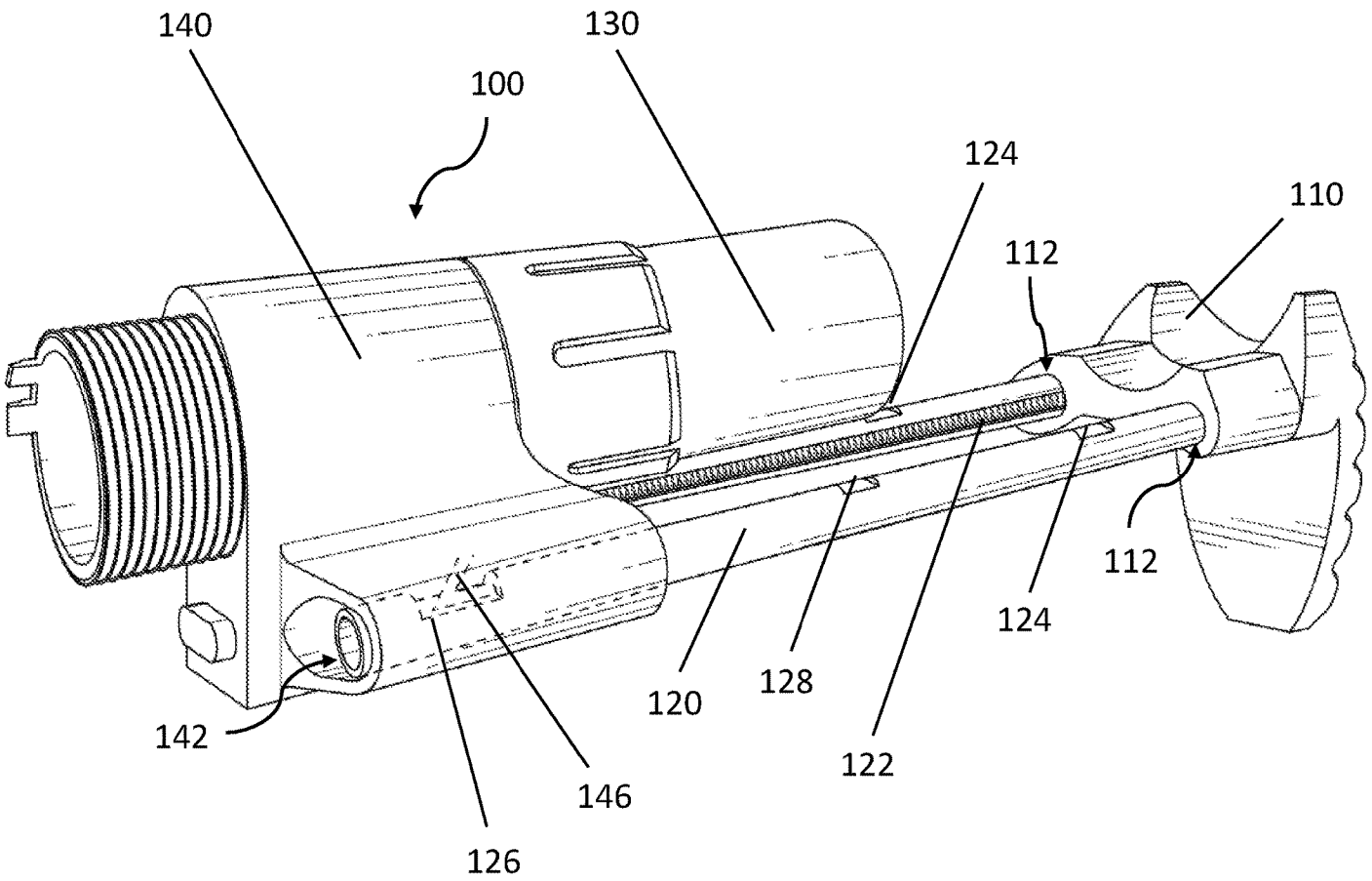
FIG. 1 is a schematic perspective view of the retractable buttstock in a decompressed state in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or" coupled" to another element, it can be directly connected or coupled to the other element or intervening elements may be present. In contrast, when an element is referred to as being" directly connected" or "directly coupled" to another element, there are no intervening elements present.

Figure 2:
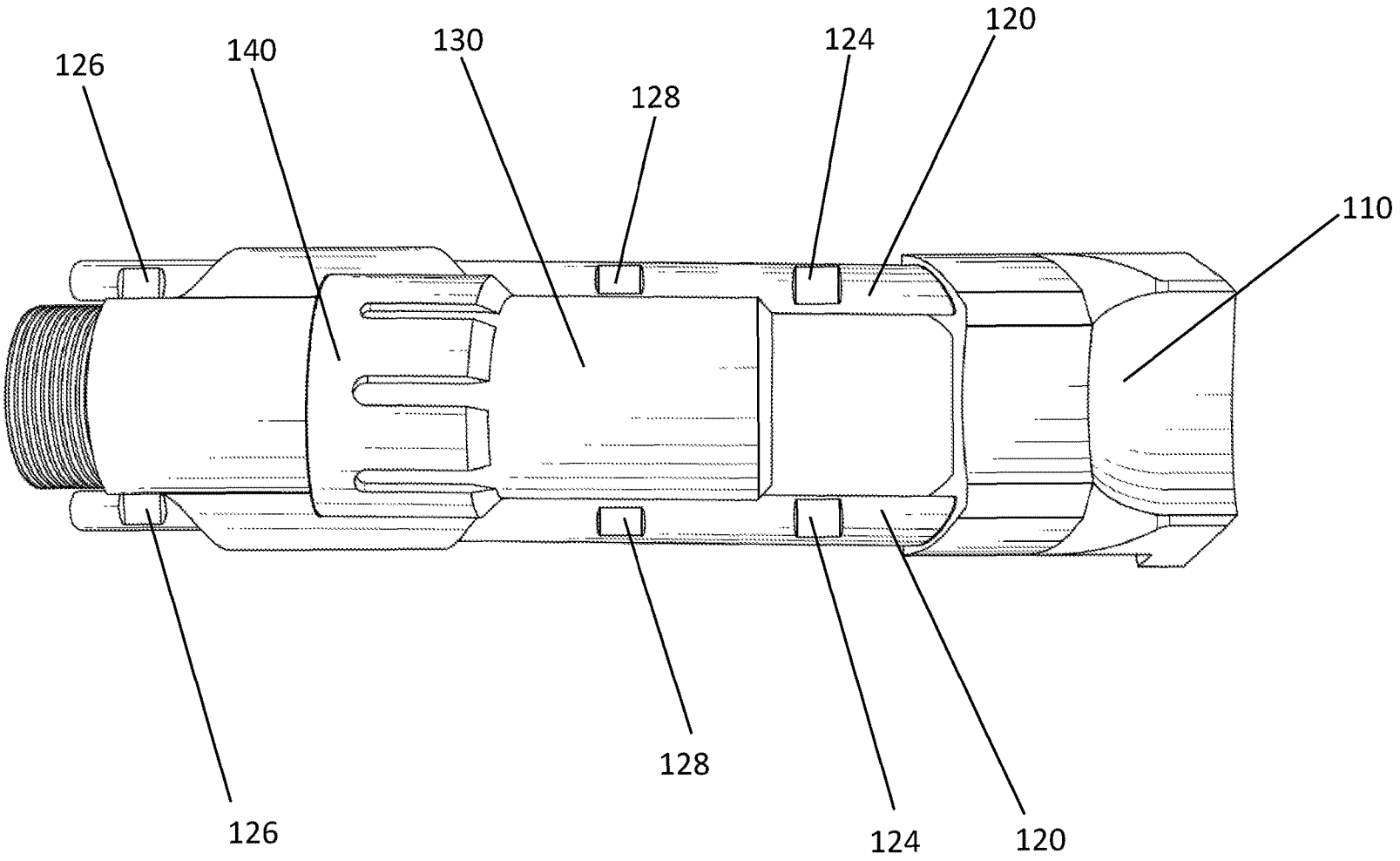
FIG. 2 is a schematic top view of the retractable buttstock in the present invention.
Figure 3:
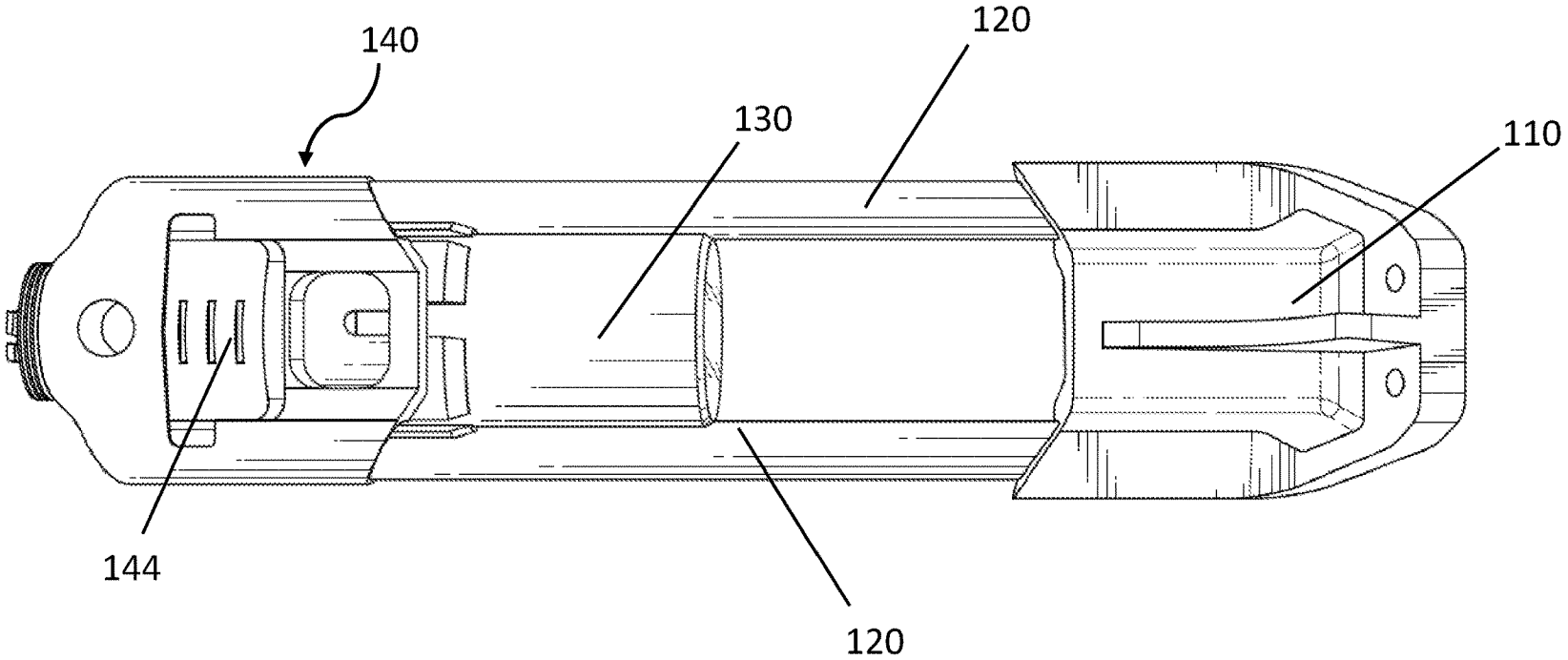
FIG. 3 is a schematic bottom view of the retractable buttstock in the present invention.

In order to further understand the goal, characteristics and effect of the present invention, a number of embodiments along with the drawings are illustrated as following:

In one aspect, referring to FIGS. 1 to 3, a retractable buttstock 100 may include a buttpad 110 that allows the user to rest the weapon on their shoulders, so the weapon is stabilized and is easier for the user to shoot; a pair of extension rods 120; a buffer tube 130 that is part of the firearm that allows the buttstock to attach to the firearm; and a buffer tube housing 140 to receive the buffer tube. In one embodiment, the buttpad 110 has a first pair of receiving holes 112, and each receiving hole 112 is configured to receive one end of each extension rod 120. The buffer tube housing 140 has a second pair of receiving holes 142, and each receiving hole 142 is configured to movably receive the other end of each extension rod 120. In other words, the buffer tube housing 140 can slide along the extension rods 120 from one end to the other end thereof. In one embodiment, the buttstock 100 can be used for an Armalite AR-10 or a DPMS LR308 pattern rifle. In another embodiment, the buttstock 100 can be used for an AR-15.

In an exemplary embodiment, the extension rods 120 are hollow and a resilient unit 122 is received in each extension rod 120. The extension rods 120 may have one or more pairs of positioning grooves including a pair of first positioning grooves 124 closer to the first receiving holes 112 and a pair of second positioning grooves 126 closer to the second receiving holes 142. It is noted that each of the first and second positioning grooves (124, 126) is located at a substantially similar position on each extension rod 120. The extension rod 120 may also have a pair of third positioning grooves 128 located between the first and second positioning grooves 124 and 126 to secure the buffer tube housing 140. The buffer tube housing 140 has a release button 144 underneath the second receiving holes 142, and the release button 144 has a pair of stoppers 146 to engage with either the first positioning grooves 124 or second positioning grooves 126.

The retractable buttstock 100 is at a fully extended configuration as shown in FIG. 1, in which each resilient unit 122 in each extension rod 120 is fully extended. In the fully-extended configuration, the stoppers 146 of the release button 144 engage with the second positioning grooves 126.

Figure 4:
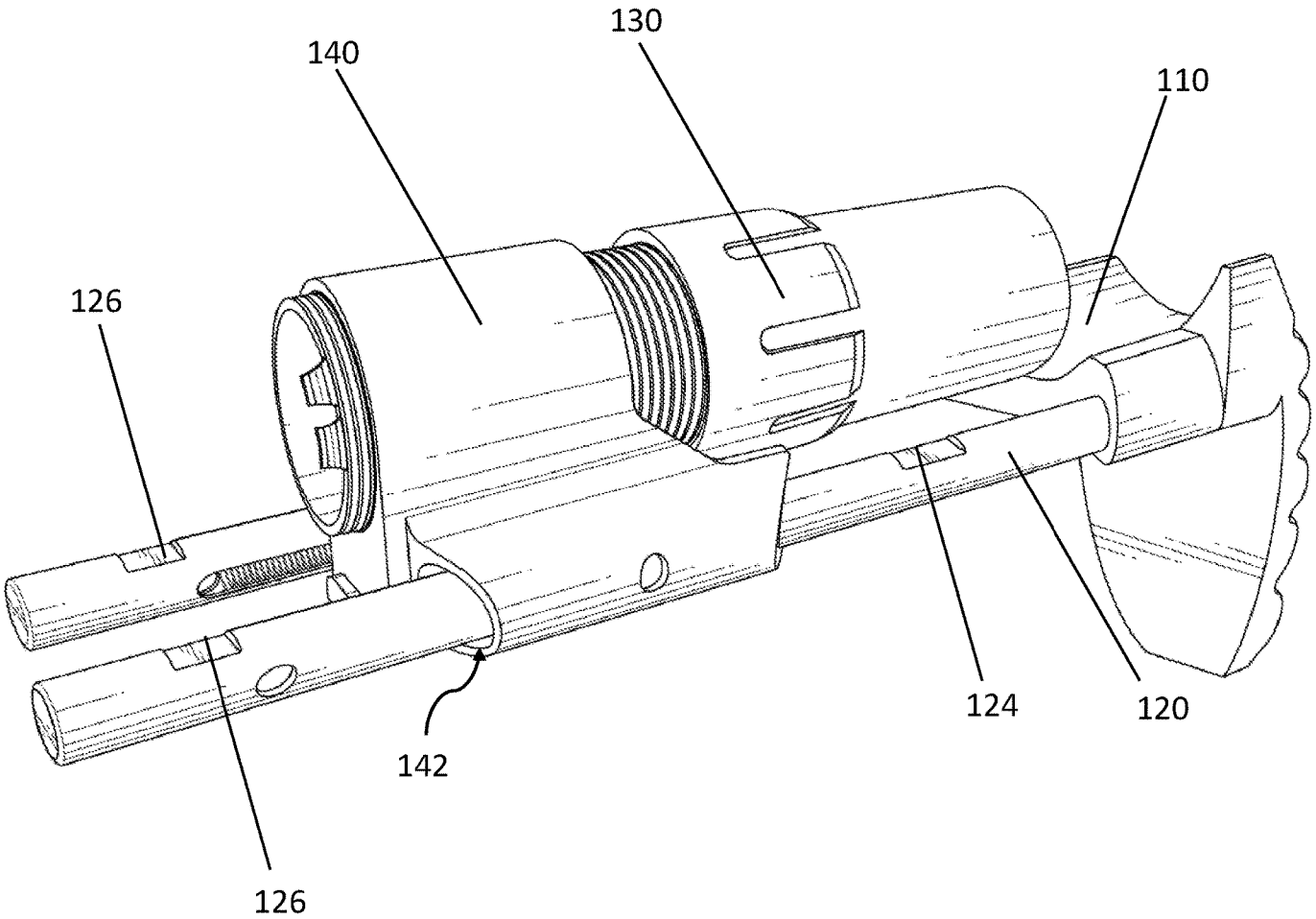
FIG. 4 is a schematic view of the retractable buttstock in a semi-compressed state.
Figure 5:
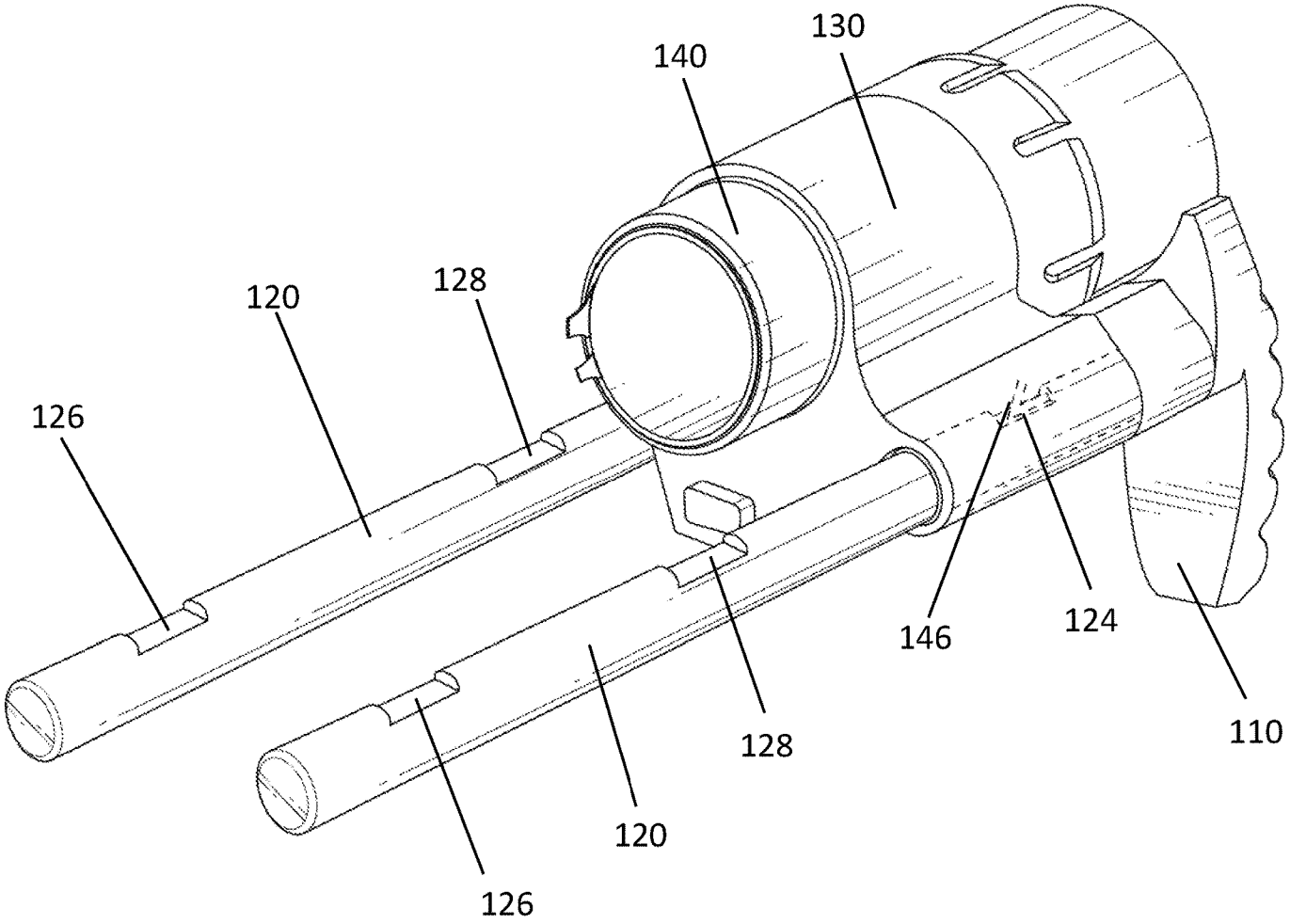
FIG. 5 is a schematic view of the retractable buttstock in a compressed state.

When the user wants to collapse the buttstock 100, the user can simply press the release button 144 to disengage the stoppers 146 with the second positioning grooves 126, and move the buffer tube housing 140 towards the buttpad 110 as shown in FIG. 4. It is noted that since the resilient units 122 are in their fully extended positions at the time when the buttstock is being collapsed, an external force from the user has to be applied to the resilient units 122 to compress the resilient units 122 until the stoppers 146 of the release button 144 engage with the first positioning grooves 124 as shown in FIG. 5.

To return to the fully-extended configuration from the collapsed configuration, the user can simply press the release button 144. More specifically, when the release button 144 is pressed, the stoppers 146 disengage with the first positioning grooves 124 and the buffer tube housing 140 can automatically move away from the buttpad 110 until the stoppers 146 engage with second positioning grooves 126. It is noted that since the resilient units 122 are at their compressed positions at the time when the buttstock is being extended, the resilient force of the resilient units 122 will push the buffer tube housing 140 without applying any external force. Relatively speaking, if the buffer tube housing 140 is fixed to a firearm, the buttpad 110 would automatically move away from the buffer tube housing 140 through the movement of the extension rods 120 when the configuration of the buttstock is changing from collapsed (FIG. 5) to fully-extended (FIG. 1).

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A retractable buttstock for a firearm that is configured to transition from a collapsed position and a fully-extended position and vice versa comprising:

a buttpad that allows a user to rest the firearm on a user's shoulder;

a pair of extension rods; each extension rod having a lateral elongated receiving space extending through a sidewall thereof and receiving a resilient unit therein that faces the other resilient unit in the other extension rod; and a buffer tube housing having a release button, wherein the buttpad has a first pair of receiving holes, and each first pair receiving hole is configured to receive one end of each extension rod; the buffer tube housing also has a second pair of receiving holes, and each second pair receiving hole is configured to movably receive the other end of each extension rod;

wherein the extension rods have a pair of first positioning grooves closer to the first receiving holes and a pair of second positioning grooves closer to the second receiving holes; each of the first positioning grooves is located at a substantially similar position on each extension rod while each of the second positioning grooves is located at a substantially similar position on each extension rod;

wherein the release button has a pair of stoppers corresponding to the first and second positioning grooves; the buttstock reaches the collapsed position when the stoppers of the release button engage with the first positioning grooves while the buttstock reaches the fully-extended position when the stoppers engage with the second positioning grooves.

2. The retractable buttstock for a firearm of claim 1, further comprising a buffer tube that allows the buttstock to attach to the firearm.

3. The retractable buttstock for a firearm of claim 1, wherein the release button is pressed to disengage the stoppers with the second positioning grooves and an external force has to be applied to the buttpad to compress the resilient unit in each of the extension rods to collapse the buttstock until the stoppers engage with the first positioning grooves.

4. The retractable buttstock for a firearm of claim 2, wherein the release button is pressed to disengage the stoppers with the second positioning grooves and an external force has to be applied to the buttpad to compress the resilient unit in each of the extension rods to collapse the buttstock until the stoppers engage with the first positioning grooves.

5. The retractable buttstock for a firearm of claim 1, wherein the release button is pressed to disengage the stoppers with the first positioning grooves and the buttpad is automatically pushed away from the buffer tube housing by a resilient force exerted by the resilient unit in each of the extension rods until the stoppers engage with the second positioning grooves.

6. The retractable buttstock for a firearm of claim 2, wherein the release button is pressed to disengage the stoppers with the first positioning grooves and the buttpad is automatically pushed away from the buffer tube housing by a resilient force exerted by the resilient unit in each of the extension rods until the stoppers engage with the second positioning grooves.

7. The retractable buttstock for a firearm of claim 4, wherein the release button is pressed to disengage the stoppers with the first positioning grooves and the buttpad is automatically pushed away from the buffer tube housing by a resilient force exerted by the resilient unit in each of the extension rods until the stoppers engage with the second positioning grooves.

8. The retractable buttstock for a firearm of claim 4, wherein the extension rods include a pair of third positioning grooves to engage with the stoppers to secure the buffer tube housing between the first and second positioning grooves.

* * * * *